United States Patent [19]

Raymond

[11] 4,073,565

[45] Feb. 14, 1978

[54] SPARK PLUG TERMINAL

[76] Inventor: Eugene B. Raymond, 4041 West Grove, Skokie, Ill. 60076

[21] Appl. No.: 802,821

[22] Filed: June 2, 1977

Related U.S. Application Data

[63] Continuation-in-part of Ser. No. 650,889, Jan. 21, 1976, abandoned.

[51] Int. Cl.[2] ..... H01R 11/08

[52] U.S. Cl. ..... 339/223 S; 339/245

[58] Field of Search ..... 339/223, 245

[56] References Cited

U.S. PATENT DOCUMENTS

| | | | |
|---|---|---|---|
| 3,223,963 | 12/1965 | Rarey et al. | 339/223 S |
| 3,597,723 | 8/1971 | Schmidt | 339/223 S |
| 3,793,616 | 2/1974 | Moehrke | 339/223 S |
| 3,918,789 | 11/1975 | Davis | 339/245 |

*Primary Examiner*—Joseph H. McGlynn
*Attorney, Agent, or Firm*—Edward C. Threedy

[57] ABSTRACT

A sleeve type spark plug terminal formed from sheet metal stock and providing a U-shaped bendable elbow area of a reduced width and radius and composed of a plurality of elongated strips formed by slots extending through the area so as to facilitate bending thereof, and a spring clip for clamping one end of the sleeve terminal together.

3 Claims, 8 Drawing Figures

SPARK PLUG TERMINAL

This application is a continuation-in-part of my patent application, Ser. No. 650,889, filed Jan. 21, 1976, now abandoned.

SUMMARY OF THE INVENTION

Prior sleeve-type elbow terminals have been commonly fabricated from sheet metal stock to provide an essentially tubular sleeve open at both ends. One sleeve end of the terminal is adapted for permanently receiving in electrical contact the ends of an insulated wire conductor. The other sleeve end serves as a female type terminal for detachably engaging the mating plug of either a spark plug or a mail type terminal of another conductor.

In recent years, the under-hood temperature created by internal combustion engines as normally used in automotive vehicles has necessitated the use of silicone protectors which are particularly susceptible to physical and electrical damage. The bend at the elbow of prior sleeve terminals was a source of difficulty, in that during the bending of the sleeve at the elbow area, the stock material tended to bow outwardly from the normal circumference of the terminal and present sharp edges, producing points of electrical discharge and which ruptured or ripped the insulating boot or protector, permitting moisture, dirt, and contaminating substances to penetrate and causing electrical interferences to be introduced into the terminal at such points.

The sleeve type spark plug terminal of my present invention is formed from sheet metal stock and provides a bendable elbow area of reduced width. Such area has formed therein a plurality of slots extending longitudinally of the terminal so as to provide elongated areas of continuous metal strips, assuring proper electrical conductive capacities through the elbow area. The slots also permit the terminal to be bent at the elbow area without causing displacement of metallic parts outwardly of the circumference of the terminal so as to remove any possibility of electrical discharge points or of rupturing or ripping the insulating boot that is placed thereover.

The constant inward movement of the slotted sections of the terminal of this invention when bent, reduces the diameter of the bent section, thereby preventing any sharp edges from physically damaging the terminal protector or boot and prevents any high density discharge which can occur when there is present a sharp edge or pointed protrusion.

It should be noted that in the terminal of this invention, upon being bent the center elbow section bends in toward the center and away from the walls of the protector or boot, and that the two outer areas in bending in and meeting one another, greatly reinforce and strengthen the terminal at any set angle of bend. Even when the terminal is used without being bent, such middle section is of a reduced diameter to prevent pressure against the inner wall of the protective boot or terminal protector.

I have also provided a newly designed spring clip which maintains the female end of the terminal sleeve in its prescribed radius and which will prevent enlargement thereof through the projection or removal of the male plug or wire conductor therein.

GENERAL DESCRIPTION

The objects of this invention are achieved through the construction illustrated in the accompanying drawings which disclose the preferred form of embodiment of the invention, and in which.

Figure 1A:
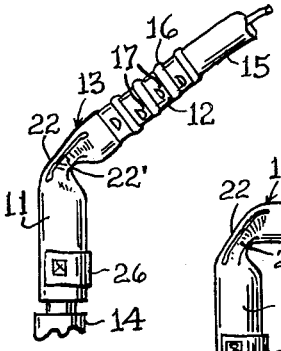
FIGS. 1A and 1B show the terminal of this invention bent at various angles.

The sleeve type spark plug terminal 10 as shown consists of two sleeve legs 11 and 12 joined together by a medial portion 13. The sleeve leg 11 is formed into a complete circular structure so as to provide a tube-like receptacle for the exposed end of a spark plug 14 partially shown in FIGS. 1A and 1B. The opposite sleeve leg 12 is formed into a semicircular cross-sectional configuration as shown and is adapted to receive the free end of an electrical cable 15 and be clamped thereabout in a manner well known in the art.

As shown, the sleeve leg 12 is also formed so as to provide a corrugated surface 16, with certain of the reduced corrugations having struck therefrom inwardly thereof gripping tangs 17 which, when the sleeve leg 12 is clamped about the electrical conductor 15, will grip the insulation thereof without puncturing or rupturing the same.

Figure 4:
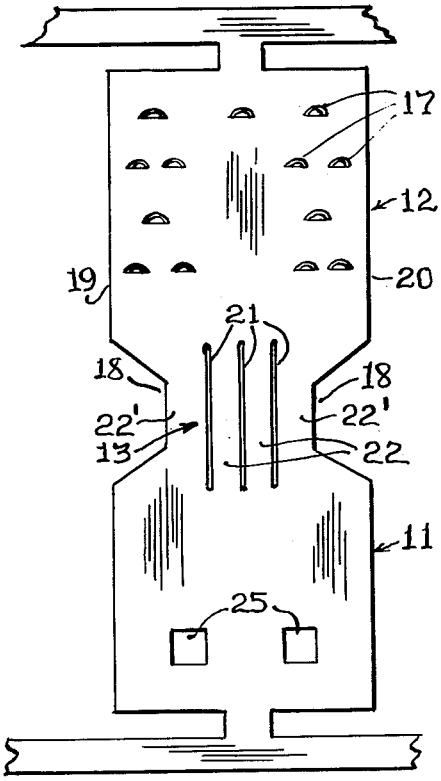
FIG. 4 is an enlarged plan view of the terminal in its first fabricated state.

The reduced medial section 13 of the spark plug terminal 10 is formed by truncated triangular notches 18 cut in the opposite longitudinal edges 19 and 20 of the spark plug terminal as shown in FIG. 4.

This medial section 13 has formed therein a plurality of longitudinally extending slots 21 which provide throughout the medial section 13 a plurality of elongated metallic strips 22 that function to provide a continuous strip of electroconductive metal between the two sleeve legs 11 and 12.

It should be noted that the slots 21 are of a length so as to extend beyond the reduced medial portion 13 and of such length that they are equal to or slightly longer than the distance between the case points of the truncated notches 18.

Figure 2:
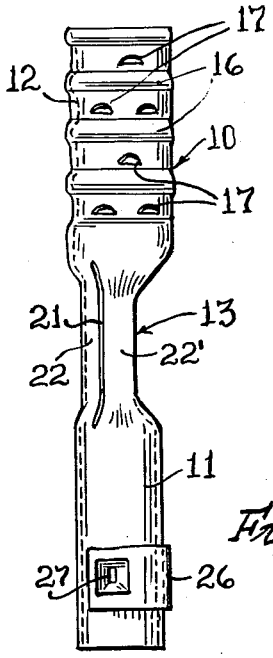
FIG. 2 is a side elevational view of the terminal of this invention.
Figure 3:
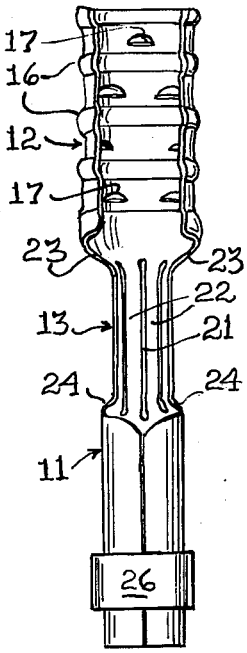
FIG. 3 is a front elevational view of the terminal of this invention.

When the terminal is formed into its completed condition such as shown in FIGS. 2 and 3, the medial portion 13 will be formed into a substantially U-shaped configuration and have a radius less than the diameter of the sleeve leg 11 or the radius of the semicircular leg 12.

In forming the reduced U-shaped medial portion 13 there result tapered wall sections 23 and 24. As shown, the tapered walls 23 extend from the U-shaped medial section 13 to the semicircular sleeve leg 12, while the tapered walls 24 extend to the tubular sleeve leg 11. As clearly shown in FIGS. 2 and 3, the slots 21 extend through these tapered wall sections 23 and 24.

Figure 1B:
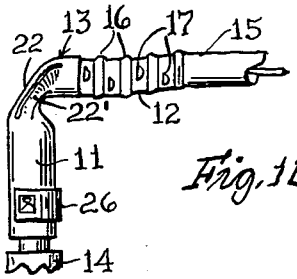
Figure 7:
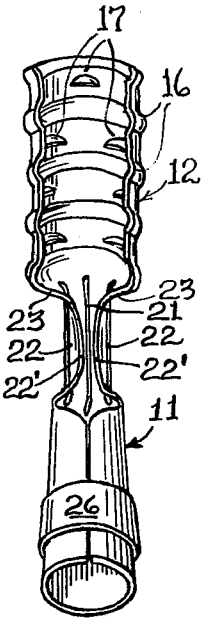
FIG. 7 is an enlarged view of the underside of the terminal in a preformed condition.

By this construction, the U-shaped medial section 13 consists of a plurality of strips 22 which terminate at their outermost ends into tapered walls 23 and 24. The slots 21 which form the strips 22 are of a length to extend into the tapered walls 23 and 24 so as to provide through the tapered walls 23 and 24 a bendable junction between the outermost ends of the strips 22 and the sleeve legs 11 and 12, whereby the sleeve legs 11 and 12 may be bent with respect to each other through any angle, such as shown in FIGS. 1A and 1B, with the strips 22' collapsing inwardly with respect to the remaining strips 22 (FIG. 7).

The collapsing inwardly of the outermost strips 22' when the sparkplug terminal is bent, as shown, prevents any sharp protrusions from extending beyond the diameter of the spark plug terminal so that when the insulating boot or protective member is placed thereover, the same will not be ruptured or punctured and will remain in a condition to perform its function of insulating a terminal. In the event that a terminal is not bent at any angle, the reduced medial portion 13, being of a smaller radius, is spaced from the inner diameter of the protective member.

Another advantage achieved by the use of this specific construction is that the spark plug terminal, when bent into any position such as indicated by the drawings, will retain the bent position during removal of the terminal from the sparkplug 14. This is highly desirable because in normal practice the terminal is removed from the spark plug by one's merely grasping the cable 15 and pulling thereon. It is therefore necessary that the terminal retain its bent position during such applied removal force. The prior art devices heretofore were not capable of maintaining their bent position during such operation.

Figure 5:
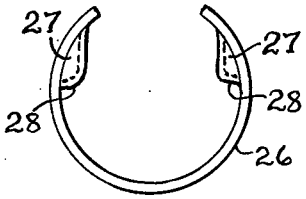
FIG. 5 is an enlarged plan view of the spring clip as employed in this invention.
Figure 6:
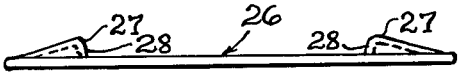
FIG. 6 is an enlarged side elevational view of the spring clip prior to its application.

Formed in the side wall of the sleeve leg 11 are a pair of spaced horizontally aligned square apertures 25. These apertures 25 are adapted to cooperate with a band clamp 26 for securing the abutting edge surfaces of the metal stock together when the leg 11 is formed in the radius shown in FIGS. 2 and 3. The band clamp 26, as clearly shown in FIGS. 5 and 6, is provided at either end thereof with keepers 27 which provide flat shoulders 28 which, when the band clamp 26 is snapped upon the end of the sleeve leg 11, will project into the square apertures 25 and have flat, full contact with the associated edges of such apertures 25.

This band clamp 26 maintains the end of the sleeve leg 11 in its prescribed circular formation and prevents the separation during the projection or removal of the male end of the spark plug 14 or male connector.

From the foregoing, it is apparent that I have disclosed a superior sleeve-type elbow terminal which is readily adapted for efficient and economical manufacture by conventional progressive automatic die-forming and cutting processes, the complete terminal providing means for securing and permanently gripping a cable in electrical contact therewith, and further characterized by having a greatly improved elbow area whereby the sleeve legs may be bent with respect to each other a multitude of desired angles.

While I have illustrated and described the preferred form of construction for carrying my invention into effect, this is capable of variation and modification without departing from the spirit of the invention. I, therefore, do not wish to be limited to the precise details of construction set forth but desire to avail myself of such variations and modifications as come within the scope of the appended claims.

Having thus described my invention, what I claim as new and desire to protect by Letters Patent is:

1. A spark plug terminal formed from a single sheet of material comprising a. an elongated body providing at one end a spark plug receiving member and at the opposite end a conductor receiving member, b. said body having portions of its opposite longitudinal side edges notched to provide a U-shaped medial section, c. elongated slots formed in said U-shaped medial section, with said slots being equally spaced from each other and from said notched side edges of said body so as to provide a plurality of collapsible strips extending between said spark plug receiving member and said conductor receiving member, d. each of said strips terminating at its outermost ends into a tapered wall whereby the medial portion of each of said strips lies in a plane different from that of said sparkplug receiving member and said conductor receiving member, e. said slots being of a length to extend into said tapered walls so as to provide a bendable junction between said outermost ends of said strips and said spark plug receiving member and said conductor receiving member, whereby said members may be bent with respect to each other, with certain of said strips collapsing inwardly with respect to the remaining strips.

2. A spark plug terminal as defined by claim 1, wherein the spark plug receiving member is adapted to be cylindrical in cross section, and including means for maintaining said spark plug receiving member in its cylindrical condition.

3. A spark plug terminal as defined by claim 2, wherein said means maintaining said spark plug receiving member in its cylindrical condition comprises a band clamp adapted to embrace said member, with said band clamp providing substantially flat locking shoulders adapted to be biased into substantially square apertures formed in said spark plug receiving member.

* * * * *